US006111908A

United States Patent [19]

Jones

[11] Patent Number: 6,111,908

[45] Date of Patent: Aug. 29, 2000

[54] HIGH TEMPERATURE VACUUM HEATER SUPPORTING MECHANISM WITH CUP SHAPED SHIELD

[76] Inventor: William R. Jones, P.O. Box 205, Telford, Pa. 18969

[21] Appl. No.: 09/375,027

[22] Filed: Aug. 16, 1999

[51] Int. Cl.[7] ..... H05B 3/66

[52] U.S. Cl. ..... 373/128; 373/131

[58] Field of Search ..... 373/117, 127, 373/128, 129, 130, 131

[56] References Cited

U.S. PATENT DOCUMENTS

| | | | |
|---|---|---|---|
| 4,259,538 | 3/1981 | Jones | 373/130 |
| 4,425,660 | 1/1984 | Jones | 373/130 |
| 4,559,631 | 12/1985 | Moller | 373/130 |
| 4,608,698 | 8/1986 | Moller et al. | 373/130 |
| 5,930,285 | 7/1999 | Moller | 373/128 |

*Primary Examiner*—Tu Ba Hoang

[57] ABSTRACT

An electrical insulating and heating element support mechanism for a high temperature vacuum furnace having a support rod with an electrical insulating and support mechanism for connecting a heating element to the rod in an electrically non-connected position includes insulators and cup shaped shields each with a wall radially surrounding an insulator. The electrically non-connected shield wall is spaced from the heating element and the insulator radial surface but covers at least a portion of the insulator radial surface to protect the mechanism from deposition of conductive materials that could cause shorts that could damage the furnace and materials being treated in the furnace. The walls of the cup shaped shields can be shaped in a number of different ways, for example, cylindrical or flared, but desirably have a circular radial dimension. The shields are desirably made with graphite.

10 Claims, 8 Drawing Sheets

SHT. 15/19

SECTION E-E

HIGH TEMPERATURE VACUUM HEATER SUPPORTING MECHANISM WITH CUP SHAPED SHIELD

FIELD OF THE INVENTION

This invention relates to heat treating furnaces that employ electric resistance heating elements, and in particular, to improved support mechanisms for suspending such elements including improved shielding devices and methods for reducing the occurrence of shorting at the support mechanism.

BACKGROUND OF THE INVENTION

Vacuum heat treating furnaces which employ electrical resistance heating elements are well known. A typical vacuum furnace has a furnace wall and a hot zone chamber of a circular cross-section which houses a series of banks of axial-spaced electrical resistance heating elements suspended from an inner wall of the hot zone chamber by a series of support rods. A heating element is generally made from graphite or molybdenum or a metal alloy, and generates radiant heat in response to electrical current passing therethrough. Popular designs are presented in U.S. Pat. No. 4,559,631 and in my U.S. Pat. No. 4,259,538 (hereafter "the 538 patent").

In the 538 patent I described the problems that arise in connection with operating a vacuum furnace structure which has the insulating material and the heating element, or heating elements, mounted in the heating chamber of the vacuum furnace by a plurality of suitably attached molybdenum rods. The molybdenum rods are conductors of electricity and accordingly must be electrically insulated from the heating element which provides heat (by passing electrical current therethrough) in accordance with its electrical resistance characteristics ($I^2R$). It was determined by me at the time of the invention, described and claimed in the above mentioned patent, that electrical insulator devices should be employed to separate the molybdenum mounting rods from the heating element. It was also determined at that time that some of the work piece material evaporates and condenses on the insulator devices to provide a material buildup between the molybdenum rod and the heating element thereby providing a "short circuit". The above mentioned patent teaches the use of molybdenum shields to partially block the space between the molybdenum rod and the electrical insulator device so that no buildup of material can occur therebetween. At the same time said molybdenum shields intercept vaporized work piece material before it condenses on the outer surfaces of the electrical insulator devices. The foregoing described shields have worked out satisfactorily except in certain situations where the temperatures have been sufficiently high and the cycling time sufficiently long, so that the molybdenum shield material, per se, has vaporized and simultaneously the minute amounts of water vapor, (in what would otherwise be a true vacuum), have broken down into hydrogen and oxygen.

It was principally the recognition of this last mentioned phenomenon that led to the conception of the invention set forth in my U.S. Pat. No. 4,425,660, entitled "Shielding Arrangement for a Vacuum Furnace" which in its entirety is incorporated herein by reference. After careful analysis it was determined that under the circumstances of high temperatures and relatively long cycling times, a certain amount of molybdenum from the molybdenum shields was in vapor form and the presence of the oxygen, from the water vapor, acted to oxidize such vaporized molybdenum. It was further determined that the electrical insulator devices have an affinity for molybdenum trioxide ($MO_3$). It was also discovered that while the molybdenum shields intercepted the vaporized work piece material such shields, per se, provided a buildup of $MO_3$. On subsequent cycles the $MO_3$ is reduced to leave molybdenum on the insulator surfaces and such a molybdenum buildup conducts electricity. The invention in U.S. Pat. No. 4,425,660 overcame that problem by providing a pair of graphite shields to be used in place of the molybdenum shields described above. In another embodiment graphite liners were secured to the sides of the above described molybdenum shields, that is to the sides which face the heating element. In yet another embodiment, the graphite liners were secured to the molybdenum shields as described earlier while in addition thereto graphite shields were located on both sides of the heating element facing the shield liners. Even though the graphite might chemically react in a manner similar to that described in connection with the molybdenum, the resulting carbon compounds will not build up on the electrical insulator devices because said electrical insulator devices do not have an affinity for said carbon compounds.

I have now found that under long, high temperature baking cycles with some metals, especially aluminum based materials, even with the improved shields of my U.S. Pat. No. 4,425,660 patent the insulator units are not protected completely from a build-up of conductive material and the problems associated with such buildup. In addition, another problem adding complexity to the solution are described in my co-pending U.S. Patent Applications respectively entitled "Heat Treating Furnace Having Improved Hot Zone" and "Process for Repairing Heat Treating Furnaces and Heating Elements Therefor," both of which were filed May 6, 1999 and are incorporated in their entirety by reference and are continuation-in-part applications of my U.S. application Ser. No. 09/027,868 filed Feb. 23, 1998. In those applications I describe the flexing heating elements are subjected to and sometimes permanent distortions that I have found to occur when such furnaces are put through repeated high temperature and then cooling cycles. The present invention describes new shields for use in high temperature furnaces that accommodate the flexion/distortion problem while substantially reducing the dangers and costs associated with electrical shorting due to conductive chemical deposition on the insulator units.

A BRIEF DESCRIPTION OF THE DRAWINGS

The objects and features of the present invention will be better understood from the following description taken in conjunction with the drawings wherein.

Figure 5:
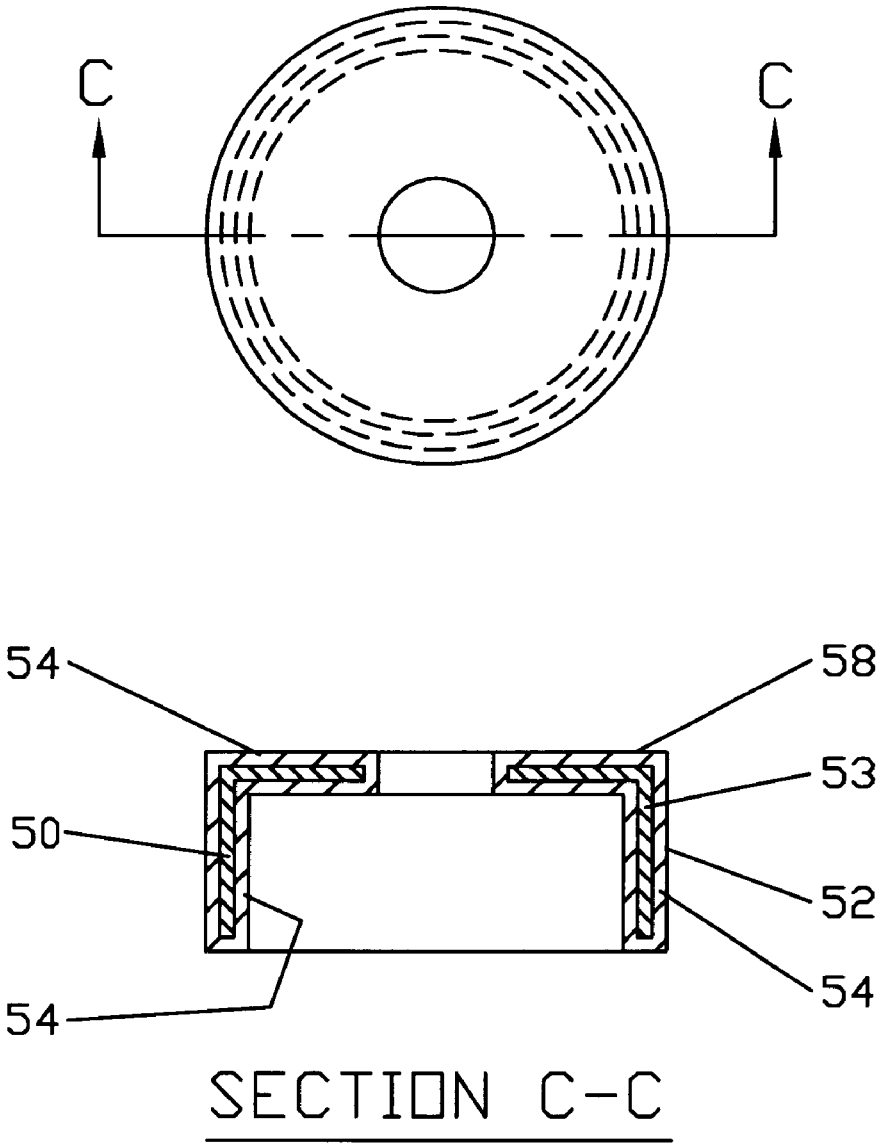

FIG. 5 top view and cross section a shield according to another embodiment of my invention wherein the shield is constructed of more than one material.

Figure 6:
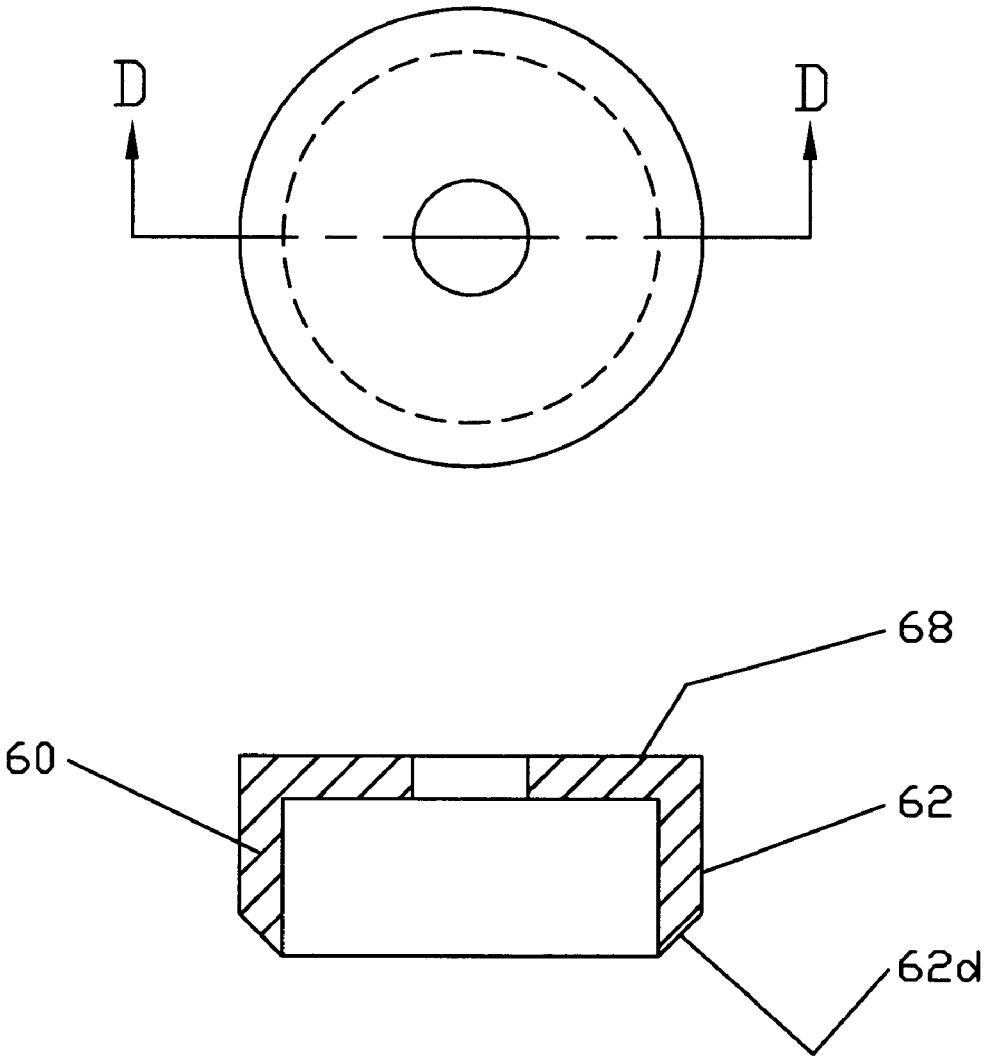
Figure 7:
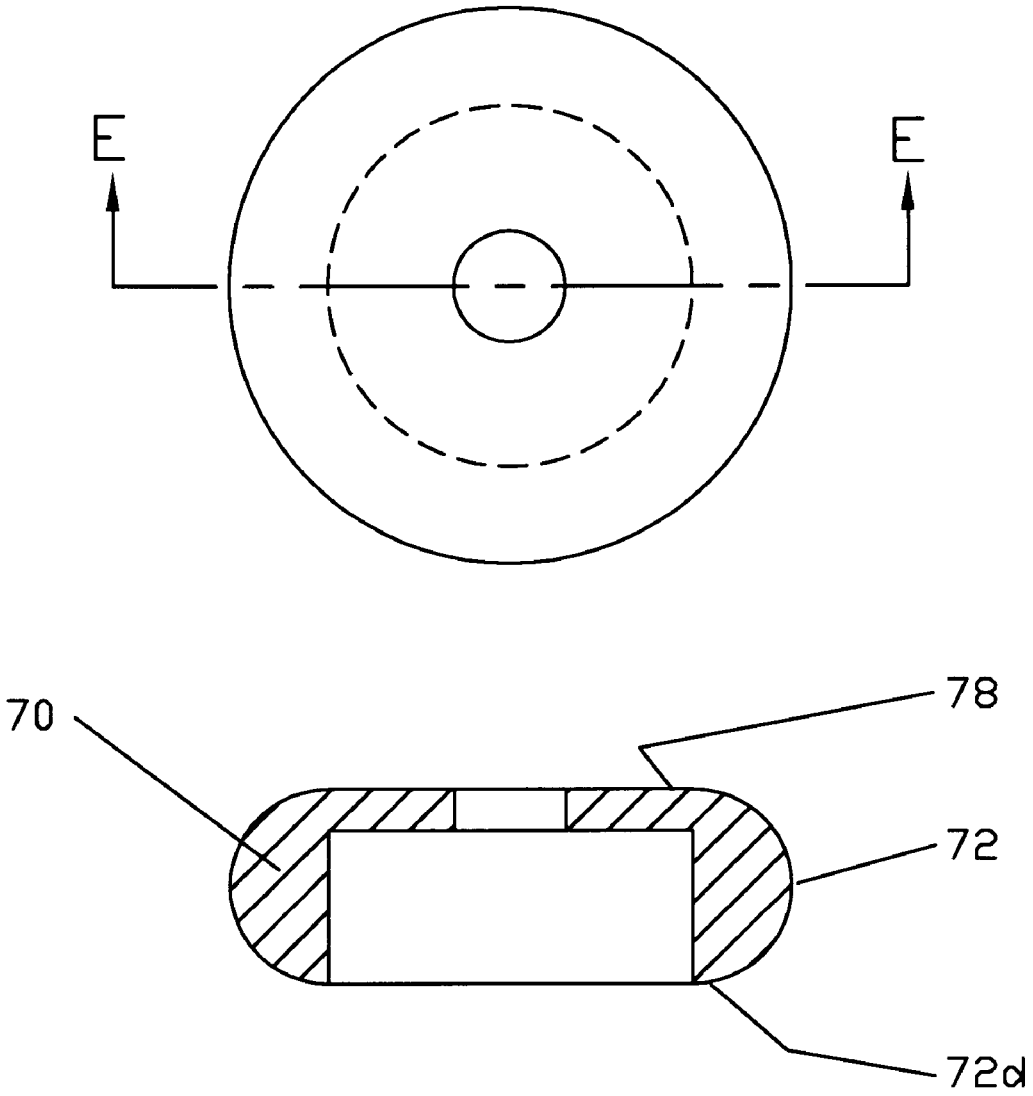

FIG. 6 top view and cross section a shield according to another embodiment of my invention wherein the lip (distal edge) of the shield is beveled; and FIG. 7 top view and cross section a shield according to another embodiment of my invention wherein the thickness of the shield walls is varied.

A DETAILED DESCRIPTION OF THE INVENTION

The present invention provides, in a preferred embodiment, improved processes and materials for repairing a high temperature vacuum furnace, for example, including a hot zone chamber having an outer and an inner wall. Such furnaces are described in my U.S. patent application Ser. Nos. 09/306,212 and 09/306,217 described above. In one embodiment of the present invention there is provided a high temperature vacuum furnace system in which electrical insulating members are provided with improved shielding configurations. The shields are shaped to provide a high shield factor with minimal interruption of heat conducted from the heating elements. By shield factor I mean the percent of the exposed axial surface of the insulator sleeve that is in the line of sight of the average size work piece(s) in the furnace. In a preferred embodiment of my invention the shield factor is at least 95%. In another embodiment the shield factor is at least 98% and in a more preferred embodiment the shield factor is 100%. The furnace system includes a furnace having heating elements supported therein in a spaced relationship to an interior wall or heat shield of the furnace. A preferred support arrangement for the system includes support rods that support the heating elements of the furnace without having electrical contact therebetween during normal furnace operations. In this embodiment electrical insulator arrangements are positioned to prevent physical contact between the support rods and the heating elements or electrically conducting apparatus connected to the heating elements. My invention provides increased protection against incidental electrical connection between the support rods and heating elements by providing improved shielding of the electrical insulators from buildup of material which is or is converted to be electrical conducting. In a preferred embodiment my invention includes an electrical insulating and heating element support mechanism for a high temperature vacuum furnace the mechanism comprising a support rod, an electrical insulating and support means for connecting said heating element to the rod in a relatively fixed or stable but electrically non-connected position. The insulating and support means includes at least one insulator having at least two surfaces, a proximal surface facing and in contact with the rod and a distal surface facing away from said rod. The insulating and support means further includes a shield spaced from and surrounding a significant portion of said distal insulator surface.

Figure 1:
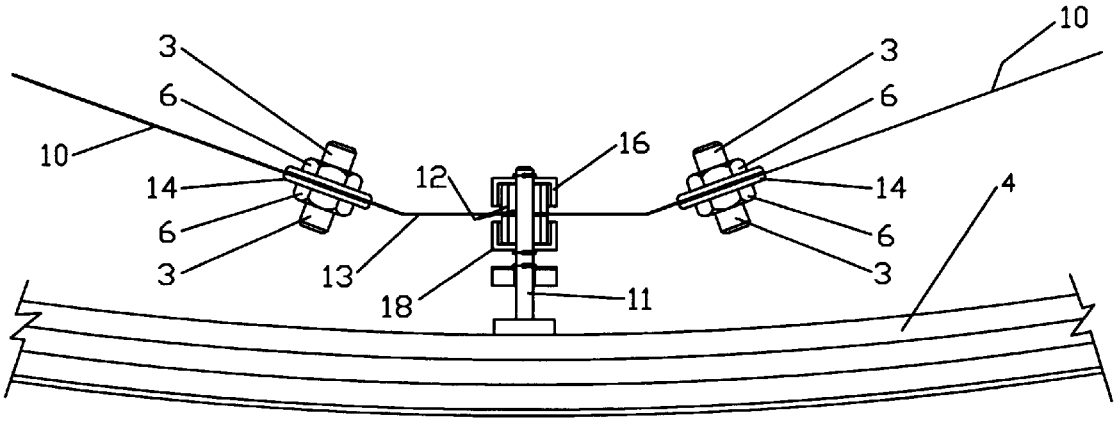
FIG. 1 depicts a cutaway section of a high temperature vacuum furnace illustrating a pair of shields in accordance with the present invention in the support mechanism that suspends the heating elements away from the furnace wall.

Conventional high temperature vacuum furnaces have an inner wall that includes a heat shield secured to it for containing radiant energy. The hot zone chamber includes a plurality of spaced polygons of electrical resistance heating elements formed to take the shape of a polygon located intermittently along the chamber. Each of the polygons comprises a plurality of heating elements sandwiched between at their transverse ends with a stabilizer means, for example, a stabilizer bar 14 and a compensator bar 13 as shown in FIG. 1. Compensator bars 13 are contoured to provide a shape to the polygon, for example an octagon or pentagon. The polygons are connected to the inner wall of the hot zone chamber by a plurality of support rods 11 (conventionally formed from relatively pure, commercially pure, molybdenum) which support each of the polygons a distance away from heat shield 4. In general, the furnace usually is formed in a substantially cylindrical shape having a substantially circular internal cross-section that is closed at its forward end by a releasable door. In one preferred embodiment of my invention heating elements 10 are electrically and mechanically connected to compensator bars 13 and stabilizer bars 14 by a series of threaded bolts 3 and retaining nuts 6. As FIG. 1 indicates, compensator bar 13 contains a central hole for receiving a part of insulator arrangement 12 (the part shown in more detail as insulator sleeve 23 in FIG. 2). Insulator sleeve 23 is fitted around support rod 11. Insulator arrangement 12 is made from a ceramic, such as alumina (See FIG. 2 for a detailed description of shields 16 and 18.). Accordingly, the heating elements 10, compensator bars 13 and stabilizer bars 14 (bars 13 and 14 with nuts and bolts forming a stabilizing means) are electrically isolated from the support rods 11. If the compensator bars are sufficiently robust (strong and rigid) a suitably formed heating element can be bolted to the compensator bar without a stabilizer bar (the compensator bar and nuts and bolts thus forming the stabilizing means). The stabilizing means could also be the interaction of the insulator mechanism clamping directly on a heating element through which rod 11 and one sleeve of he insulator mechanism project. In the embodiment illustrated in FIG. 1 the heating element bank is not formed into a complete loop, but has two ends at which an electrical power source is connected. If the banks of heating elements were not electrically isolated from the support rods 11, and the mounting rod were connected to ground, a short circuit would occur which could cause damage to the furnace. It is that type of major malfunction that my invention helps prevent.

Figure 2:
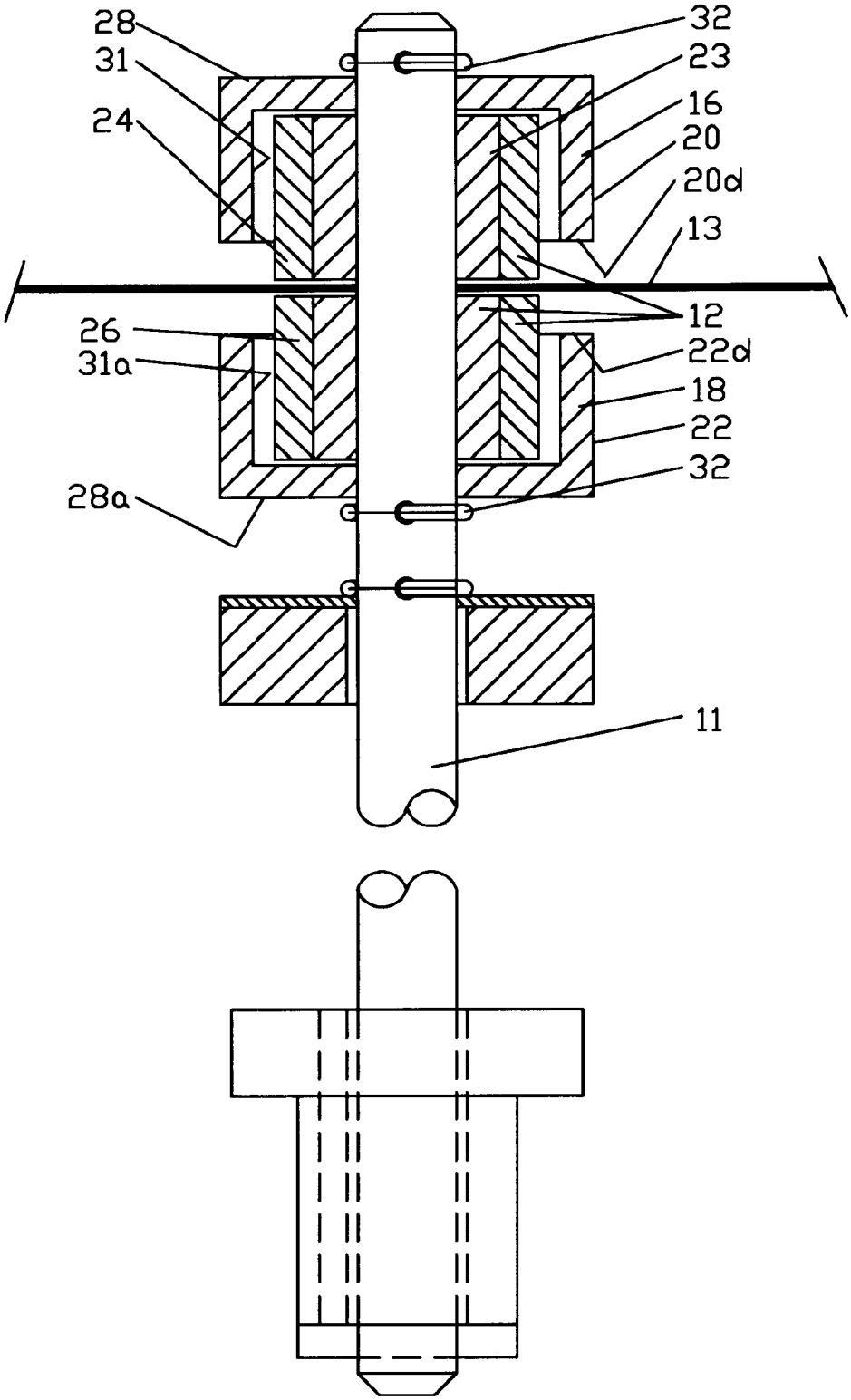
FIG. 2 depicts a dimensionally exaggerated cross-section of a support mechanism for supporting heating elements within a high temperature vacuum furnace including a pair of shields disposed to fit over a tie rod and separated by insulators in accordance with a preferred embodiment of my invention.

As shown in the detail of FIG. 2, in addition to an insulation sleeve 23 which passes through the central hole in the compensator bar, insulator sleeve arrangement 12 includes a pair of additional insulator sleeves 24 and 26 which radially surround sleeve 23 on each side of compensator bar 13. In accordance with a preferred embodiment of my invention, cup shaped shields are provided on the inside end and outside end of insulating sleeve arrangement 12. Shields 16 and 18 are preferably made of molybdenum or graphite although other similar refractory metal and ceramic materials could be used. Shields 16 and 18 have central apertures large enough to permit the passage of the support rods 11. Shields 16 and 18 are preferably in abutting relationship to the ends of insulator arrangement 12 and fixed in position by pin retainers 32. The central apertures of shields 16 and 18 can be designed to expand and/or compress around the support rods 11 to provide a shield against vapor coming to rest along the support rod and onto the compensator bar 13 or heating element 10 (FIG. 1). This can avoid the incidence of electrical short circuits therebetween. Optionally, graphite or graphite covered washers are placed over support rod 11 between the shields and their otherwise adjacent pin retainers. The washers can be designed to expand and/or compress around the support rods 11 and thereby allow additional tolerance in the design of shields 16 and 18. Alternatively, graphite sleeves can be employed between rod 11 and shields 16 and 18 in the aperture of cap faces 28 and 28*a* to prevent any materials, aluminum or other high vapor pressure conductive elements or materials, from volatilizing into the hollow section (for example, from element 10 or the workpiece) and building up on proximate surfaces of insulator arrangement 12. Graphite sleeves of course do not provide any build up material on insulator arrangement 12 because as mentioned above the ceramic insulator sleeves do not have an affinity for carbon compounds.

Figure 2A:
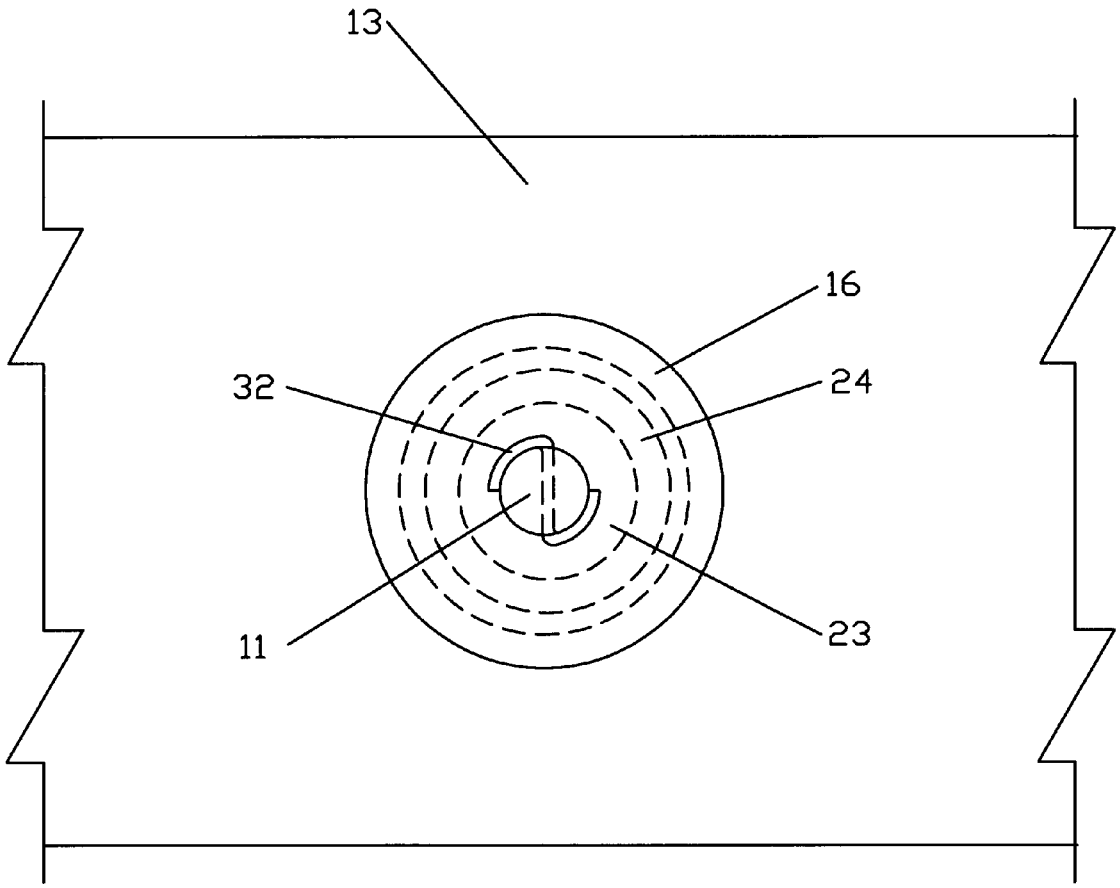
FIG. 2A depicts a view from the inside end (e.g. top view with reference to FIG. 2) of a support mechanism for heating elements within a high temperature vacuum furnace.

In FIG. 2 illustrated in cross section are two cup shaped graphite shields 16 and 18 in accordance with a preferred embodiment of my invention. Support rod (tie rod) 11 serves to tie the compensator bar 13 along with the furnace heating element and all of the insulating components and shields in spaced relationship to the side wall of the heat chamber. Extending from cap faces 28 and 28*a* are generally cylindrical walls 20 and 22 extending toward, but not touching compensator bar 13. It is important that compensator bar 13 does not touch shield walls 20 and 22 to avoid shorting contact therewith. The distance of the closest shield wall portions (distal wall edges 20*d* and 22*d*) to compensator bar 13 must, in fact, be sufficient so that as the heating element and associated hardware flexes during heating cycles as described above, bar 13 will not be close enough to shield wall distal edges 20*d* and 22*d* to be electrically connected (shorting). However, in a preferred embodiment of my invention, to provide maximum shielding distal shield wall edges 20*d* and 22*d* reach as close to bar 13 as possible while remaining electrically non-connected. That distance will vary depending upon several factors including: the distance the distal edges 20*d* and 22*d* are from rod 11; the bar thickness; the element thickness; the element thickness to width ratio; the temperature extremes the element cycles through; the speed of the cycling; and the maximum temperatures reached in the element. Because it is difficult to generalize on the minimum distance for maximum shielding benefit I have chosen to describe that distance as the "minimal operationally non-connect distance". Desirably, that distance in large furnaces is greater than one-fourth inch and preferably greater than three-eighths of an inch. In one preferred embodiment shields 16 and 18 are graphite, but for some purposes shields 16 and 18 could be made of refractory materials such as molybdenum. In another preferred embodiment the shields comprise a graphite core that is coated with a ceramic compound such as TiC or SiC (both resistant to metal adhesion) as illustrated in FIG. 5 below. The diameter of shields 16 and 18 depends on the diameter of the insulating sleeves, but is desirably about two inches. The interior surfaces 31 and 31*a* of shield walls 20 and 22 should be spaced at least about three sixteenths of an inch from insulating sleeves 24 and 26, respectively. Eliminating the line of sight between the work piece and insulator arrangement 12 is an important consideration in determining the length or profile of shield walls. FIG. 2A shows support bar 11, insulation sleeve 23 around support bar 11, insulator sleeve 24 surrounding sleeve 23, cup shaped shield 16 held in abutting relationship to sleeves 23 and 24 by pin 32. Cup shaped shield 16 covers the FIG. 2A view surface of sleeves 23 and 24 while the wall of shield 16 is spaced from and surrounds the distal surface of insulator sleeve 24 (see also FIG. 2).

Figure 3:
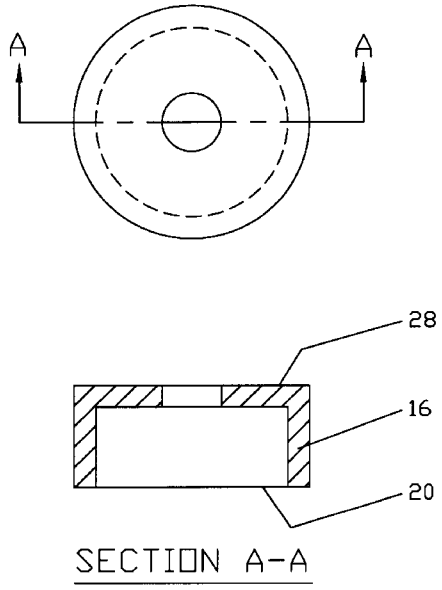
FIG. 3 depicts in top view and cross section with exaggerated dimensions a shield according to one embodiment of my invention.
Figure 4:
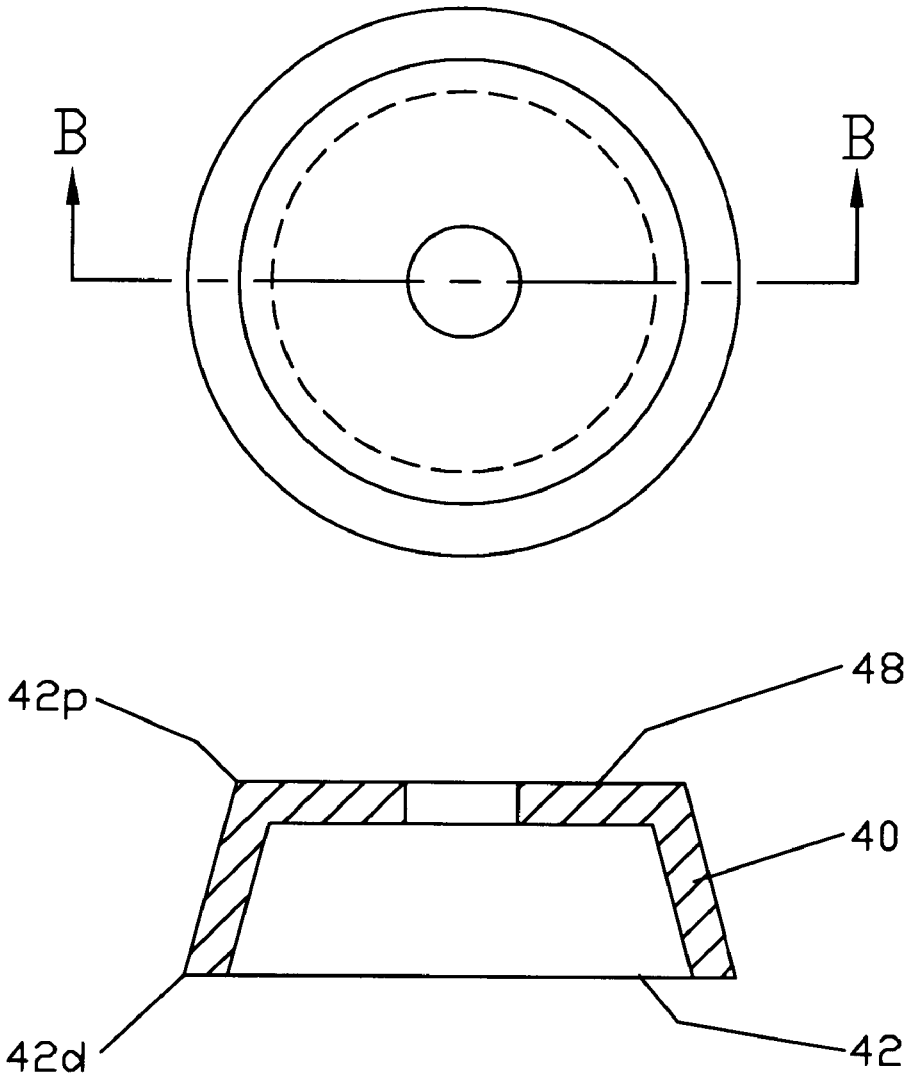
FIG. 4 depicts in top view and cross section a shield according to another embodiment of my invention further illustrating a shield with a flared wall.

To further describe a preferred shield of my invention FIG. 3 illustrates in top view and cross section long A—A cup shaped shield 16 having cylindrical wall 20 and cap face 28 but showing the aperture 15 in cap face 28 through which rod 11 would project (See FIG. 2). FIG. 4 illustrates in top view and cross section along B—B another preferred embodiment of my invention in which cup shaped shield 40 has wall 42 that is flared so that distal edge 42*d* would be further from the tie rod (see FIG. 2) than the proximal edge 42*p* would be. The proximal edge 42*p* is at the junction of wall 42 and cap face 48. FIG. 5 illustrates a way of making the cup shaped shields of my invention stronger while taking advantage of an exterior made of ceramic. Shield 50 comprises an inner core that is a cup shaped material 53, for example graphite or a refractory metal, e.g. molybdenum, surrounded on both its face cap 58 and its wall 52 (inner and outer surfaces) by ceramic 54. Ceramic 54 is secured to the core by a suitable means that would depend on the choice of core material. For a core of graphite the bond could be accomplished using various techniques. In a preferred embodiment the ceramic would be applied using a thermal reaction process.

FIG. 6 illustrates in cross section cup shaped shield 60 according to another preferred embodiment of my invention. In shield 60 the distal edge 62*d* of side wall 62 is beveled to provide additional distance between the compensator bar 13 and heating element 10 (see FIG. 2) when bar 13 and/or element 10 (see FIG. 1) distorts in the direction of side wall 62. Care should be exercised, however, in designing such a bevel because of the increased potential for shorting to the bevel point.

An additional preferred embodiment of my invention is illustrated in FIG. 7. Shield 70 illustrates with wall 72 one of many configurations that can be employed to provide additional strength to the shield. The external configuration of side wall 72 also provides the additional distance from a flexing element during furnace operation. Distal edge 72*d* of wall 70 is spaced closest to the anchor point of the element during furnace operation. The curve away from the direction of the element provides additional safety in preventing shorts due to element flexure. (Again, refer to FIG. 1 for a more complete description of the relationship of compensator bar 13 to shield 16, for which shield 70 could be substituted.)

From the foregoing, it can be understood that this invention provides improved high temperature vacuum furnaces and methods for extending the life of such furnaces. By using the shields of the present invention in new furnaces or by replacing shields of existing machines the probability of furnace failure, and resultant production interruption is decreased. Because work piece material in such furnaces can be very expensive and can be ruined by interruption, decreasing the probability for such interruption is valued highly. The new shielding devices also allow the use of such furnaces to treat work piece substances that have a higher volatility than previously practical. Although various embodiments have been illustrated and described above this is for the purpose of describing, but not limiting the invention. Various modifications, which will become apparent to one skilled in the art, are within the scope of this invention described in the appended claims.

What is claimed is:

1. In a high temperature vacuum furnace system, having a heating chamber with a general location for placing work piece material for treatment, at least one wall, at least one heating element, at least one rod member to provide a base for securing said heating element in spaced relationship to said wall, and an electrical insulating and support arrangement to be used with said rod member and said heating element, said arrangement comprising: means for stabilizing said heating element; an electrical insulating means for separating electrically said rod member from said stabilizing means and heating element and assisting in the positioning said stabilizing means and heating element, said electrical insulating means having an insulator with an exterior surface, and at least one shield intended to limit the amount of undesirable deposition on said insulating means, the improvement comprising including at least one cup shaped shield having a cup wall with a proximal edge and a distal edge, said cup wall being spaced from but in close proximity to and covering a portion of said insulator, the distal edge of said cup wall spaced from said stabilizing means and heating element.

2. A system in accordance with claim 1 wherein said shield is composed of graphite.

3. A system in accordance with claim 1 wherein said insulator exterior surface is substantially cylindrical.

4. A system in accordance with claim 1 wherein said cup wall is cylindrical.

5. An electrical insulating and heating element support mechanism for a high temperature vacuum furnace comprising a support rod, an electrical insulating and support means for connecting a heating element to said rod in a relatively stable but electrically non-connected position, said electrical insulating and support means including at least one insulator having at least two surfaces, a curved proximal surface facing said rod and a curved distal surface facing away from said rod, said electrical insulating and support means further including a cup shaped shield having a cap face and a wall spaced from and radially surrounding said curved distal surface.

6. The electrical insulating and heating element support mechanism in accordance with claim 5 wherein said wall is substantially cylindrically shaped.

7. The electrical insulating and heating element support mechanism in accordance with claim 5 wherein said cup shaped shield is graphite.

8. The electrical insulating and heating element support mechanism in accordance with claim 5 wherein said wall has a proximal edge that is proximal to said cap face and a distal edge that is distal to said cap face, said wall being flared so that said distal edge is further away from the insulator than said proximal edge.

9. The electrical insulating and heating element support mechanism in accordance with claim 5 wherein said wall has a proximal edge that is proximal to said cap face and a distal edge that is distal to said cap face, and said wall has an exterior surface from distal edge to proximal edge that is nonlinear.

10. The electrical insulating and heating element support mechanism in accordance with claim 5 wherein said wall has an exterior surface that is generally circular in its radial dimension.

* * * * *